US007790090B2

(12) United States Patent
Jallon et al.

(10) Patent No.: US 7,790,090 B2
(45) Date of Patent: Sep. 7, 2010

(54) METHOD OF MANUFACTURING SHEETS BASED ON HYDRAULIC BINDER, PRODUCTION LINE FOR PRODUCING SUCH SHEETS AND APPARATUS FOR MAKING AN IMPRESSION

(75) Inventors: Paul Jallon, Bordeaux (FR); Michel Rigaudon, Caromb (FR); Jean Louis Laurent, Bayas (FR); Jean Paul Solomut, Izon (FR)

(73) Assignee: Lafarge Platres, Avignon Cedex (FR)

( * ) Notice: Subject to any disclaimer, the term of this patent is extended or adjusted under 35 U.S.C. 154(b) by 1489 days.

(21) Appl. No.: 10/505,543

(22) PCT Filed: Feb. 25, 2003

(86) PCT No.: PCT/FR03/00606

§ 371 (c)(1),
(2), (4) Date: Feb. 23, 2005

(87) PCT Pub. No.: WO03/072326

PCT Pub. Date: Sep. 4, 2003

(65) Prior Publication Data

US 2005/0139052 A1 Jun. 30, 2005

(30) Foreign Application Priority Data

Feb. 26, 2002 (EP) ..... 02290462
May 6, 2002 (EP) ..... 02291132

(51) Int. Cl.
*B28B 5/02* (2006.01)
*B28B 17/00* (2006.01)
*B28B 11/16* (2006.01)

(52) U.S. Cl. ..... 264/333; 264/151; 264/293

(58) Field of Classification Search ..... 264/163, 264/162, 148, 151, 333, 293; 83/76.1
See application file for complete search history.

(56) References Cited

U.S. PATENT DOCUMENTS 1,439,289 A 12/1922 Buttress (Continued)

FOREIGN PATENT DOCUMENTS

CA 1 204 279 A 5/1986

(Continued)

OTHER PUBLICATIONS

Chinese Office Action (English translation only).

(Continued)

*Primary Examiner*—Matthew J. Daniels
(74) *Attorney, Agent, or Firm*—Buchanan Ingersoll & Rooney PC

(57) ABSTRACT

The invention relates to a method of manufacturing sheets based on hydraulic binder, particularly sheets of plasterboard with feathered edges. The method comprises the steps of (I) making a mark (301) on a facing (2 or 3) of the preform (5), (II) detecting the mark (301), and (III) sending an actuating signal to a device (9) for cutting the preform (5). The invention also relates to a production line for producing such sheets, and to an apparatus, particularly for making an impression (12, 12*bis*) in a preform (5). The apparatus comprises a frame (101), first (102, 103) and second (105, 106) pulleys, two belts (108, 109) wrapped around the pulleys (102, 103, 105, 106), and at least one wire (111) extending between these belts (108, 109) so that its axis is parallel to the axis of the pulleys (102, 103, 105, 106).

13 Claims, 11 Drawing Sheets

U.S. PATENT DOCUMENTS

| | | | | | |
|---|---|---|---|---|---|
| 1,676,318 | A | | 7/1928 | Birdsey | |
| 1,754,429 | A | | 4/1930 | Knode | |
| 1,856,932 | A | | 5/1932 | Shaw | |
| 1,856,936 | A | | 5/1932 | Turner | |
| 1,871,563 | A | | 8/1932 | Ericson | |
| 2,044,234 | A | | 6/1936 | Walper | |
| 2,168,803 | A | | 8/1939 | Page | |
| 2,238,017 | A | | 4/1941 | Duncan | |
| 2,246,987 | A | | 6/1941 | Roos | |
| 2,537,509 | A | | 1/1951 | Camp | |
| 2,679,215 | A | * | 5/1954 | Truesdell | 425/347 |
| 2,712,169 | A | | 7/1955 | Buttress | |
| 2,969,870 | A | * | 1/1961 | Pulver | 198/841 |
| 2,991,824 | A | | 7/1961 | Loechl | |
| 2,991,825 | A | | 7/1961 | Hampson | |
| 2,991,826 | A | | 7/1961 | Armstrong | |
| 3,050,104 | A | | 8/1962 | Burt | |
| 3,079,292 | A | | 2/1963 | Garth | |
| 3,285,676 | A | * | 11/1966 | Hetteen | 305/134 |
| 3,373,065 | A | | 3/1968 | Gutzman et al. | |
| 4,397,123 | A | | 8/1983 | Parker | |
| 4,626,389 | A | | 12/1986 | Lempfer et al. | |
| 4,781,558 | A | | 11/1988 | Betzner | |
| 5,198,052 | A | * | 3/1993 | Ali | 156/45 |
| 5,830,548 | A | | 11/1998 | Andersen et al. | |
| 5,842,280 | A | * | 12/1998 | Robell | 33/1 B |
| 5,851,634 | A | | 12/1998 | Andersen et al. | |
| 5,975,280 | A | | 11/1999 | Cote et al. | |
| 6,342,284 | B1 | | 1/2002 | Yu et al. | |
| 7,033,431 | B2 | | 4/2006 | Martin et al. | |
| 2001/0044016 | A1 | | 11/2001 | Watras | |
| 2003/0084633 | A1 | | 5/2003 | Zuber et al. | |
| 2003/0175478 | A1 | | 9/2003 | Leclecq | |
| 2003/0217799 | A1 | | 11/2003 | Falinower | |
| 2004/0007307 | A1 | | 1/2004 | Falinower | |
| 2005/0127545 | A1 | | 6/2005 | Jallon et al. | |
| 2005/0139052 | A1 | | 6/2005 | Jallon et al. | |
| 2005/0224154 | A1 | | 10/2005 | Capron | |
| 2005/0257873 | A1 | | 11/2005 | Arese et al. | |
| 2006/0198989 | A1 | | 9/2006 | Jallon et al. | |

FOREIGN PATENT DOCUMENTS

| | | | |
|---|---|---|---|
| CA | 2147118 | A1 | 5/1994 |
| CL | 1804-98 | | 4/1998 |
| DE | 872 025 | | 3/1953 |
| DE | 2 325 158 | | 12/1974 |
| DE | 36 34 533 | A1 | 4/1988 |
| DE | 42 09 594 | A1 | 9/1993 |
| EP | 0 482 810 | A1 | 4/1992 |
| EP | 1 143 084 | A2 | 10/2001 |
| EP | 1 338 393 | A1 | 8/2003 |
| EP | 1 361 030 | A1 | 11/2003 |
| FR | 2 448 422 | | 9/1980 |
| GB | 429084 | | 5/1935 |
| GB | 429379 | | 5/1935 |
| GB | 429380 | | 5/1935 |
| GB | 451389 | | 8/1936 |
| GB | 2 050 917 | A | 1/1981 |
| GB | 2 221 181 | A | 1/1990 |
| GB | 2221181 | A | 1/1990 |
| JP | 53-51227 | | 5/1978 |
| JP | 4-361006 | | 12/1992 |
| JP | 2000-288979 | A | 10/2000 |
| KR | 2001-0067920 | | 7/2001 |
| SU | 285113 | | 5/1971 |
| SU | 787173 | | 12/1980 |
| SU | 1476505 | A1 | 4/1989 |
| WO | 94/27001 | A1 | 11/1994 |
| WO | 02/068197 | A1 | 9/2002 |
| WO | 03/072326 | A2 | 9/2003 |
| WO | 03/084724 | A1 | 10/2003 |
| WO | 03/092976 | A1 | 11/2003 |
| WO | 2004/009309 | A2 | 1/2004 |
| WO | 2004/030879 | A2 | 4/2004 |

OTHER PUBLICATIONS

European Search Report dated Dec. 5, 2006 (with English translation of category of cited documents).

Russian Federation Office Action dated Feb. 25, 2003 (English translation only).

Two (2) French Search Reports dated Aug. 13, 2002 and Oct. 9, 2002.

* cited by examiner

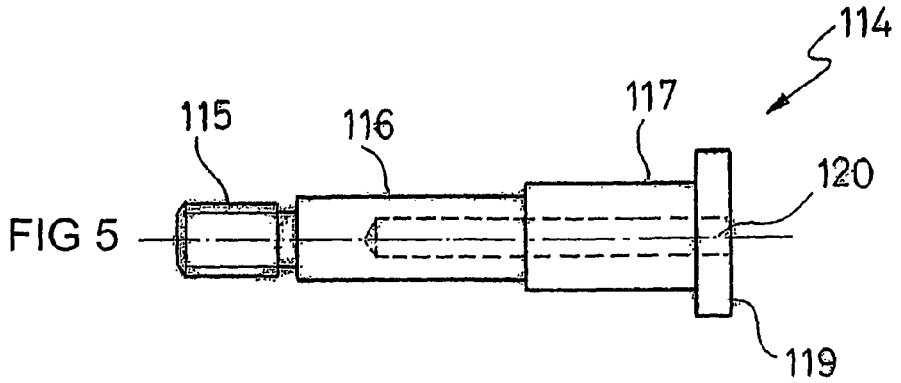
FIG 5
FIG 7
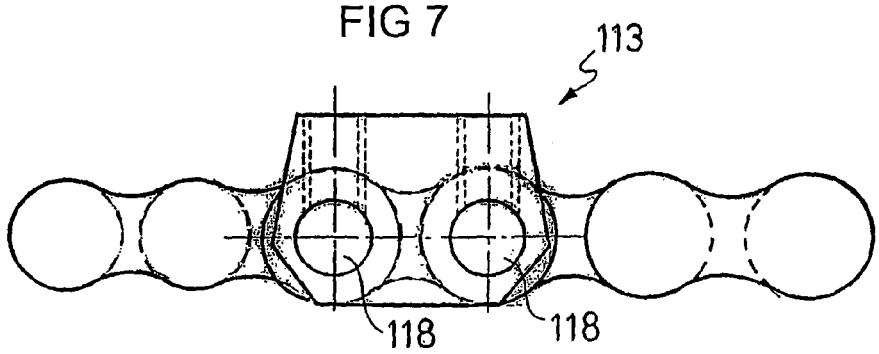
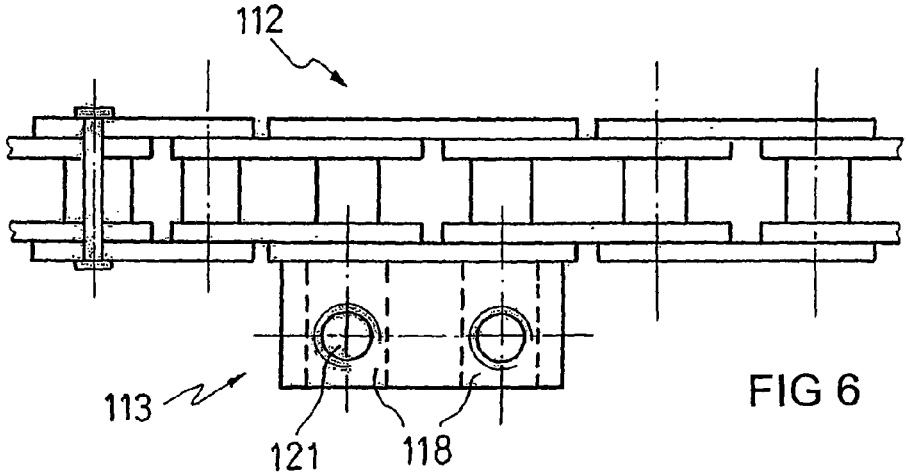
FIG 6
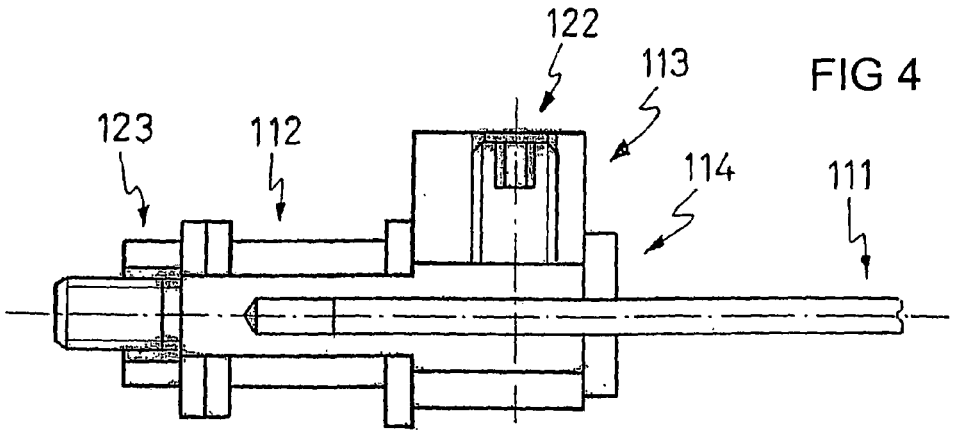
FIG 4

METHOD OF MANUFACTURING SHEETS BASED ON HYDRAULIC BINDER, PRODUCTION LINE FOR PRODUCING SUCH SHEETS AND APPARATUS FOR MAKING AN IMPRESSION

The present invention relates to a method of manufacturing sheets based on hydraulic binder, in particular sheets of plasterboard with feathered edges, to a production line for producing such sheets, and to an apparatus, particularly for making an impression in a preform based on hydraulic binder.

In a production line for producing sheets based on hydraulic binder, the sheets are generally obtained by cutting a preform based on hydraulic binder into determined lengths.

Use is therefore generally made of a cutting system made up of a wheel placed on the top of the preform and driven in rotation by the movement of this preform. The wheel is graduated and coupled to a counter which actuates the cutting device once the desired length for the sheet is reached.

The wheel and the counter are usually situated at the downstream end of the production line, a short distance away from the cutting device, this being so as to avoid the phenomena of lengthening or shortening of the preform.

The invention is aimed at proposing an alternative to this wheel/counter system.

More specifically, the invention relates to a method for manufacturing sheets based on hydraulic binder from a preform intended to be cut, this method comprising the steps of:

1) making at least one mark on a facing material of the preform (5);
2) detecting the mark; and
3) sending an actuating signal to a device for cutting the preform.

A method such as this in particular has the advantage of allowing the length of the sheet to be determined at the time of the forming of the preform.

Furthermore, it allows other operations, such as the introduction of a lath under the preform, the making of an impression in the preform or the marking of the sheet so that the mark is centered in the lengthwise direction, to be initiated.

Such a method also has the advantage that it can be used in the production of sheets based on hydraulic binder with feathered (tapered) edges.

According to one embodiment of the invention, the mark is already detected before step 2) and an impression is made in the preform.

According to another embodiment of the invention, the mark is already detected before step 2) and a lath is introduced under the preform, the composition is left to set, then the lath is removed.

According to yet another embodiment of the invention, the mark is already detected before step 2), an impression is made in the preform and a lath is introduced under the preform, the lath then advantageously being introduced after the impression has been made and where the impression has been made.

Another subject of the invention is a production line for producing sheets based on hydraulic binder from a preform, this line comprising:

a) in an upstream zone of the production line, means of marking a facing material of the preform;
b) in a downstream zone of the production line, means of detecting a mark made by the marking means;
c) a cutting device; and
d) actuating means for actuating said cutting device after receiving a detection signal from the detection means.

According to one embodiment of the production line for producing sheets based on hydraulic binder according to the invention, there are provided additional means of detecting the mark, means of making an impression in the preform and/or a device for introducing laths under the preform, additional actuating means for actuating, after receiving a detection signal from the additional detection means, said means of making an impression in the preform and/or said means of introducing laths under the preform.

According to an advantageous alternative form of this embodiment, the additional actuating means anticipate that each lath be introduced substantially where an impression has been made or opposite the place where an impression has been made.

According to another aspect of the invention, there is proposed an apparatus in particular allowing the making of an impression or reservation in a preform based on hydraulic binder.

On this subject, American U.S. Pat. No. 4,781,558 describes an apparatus intended for manufacturing sheets of plasterboard with recesses. It therefore proposes the making, on a preform intended to be cut to give sheets of plasterboard, of recesses using a drum 34 comprising bosses 36 (see in particular FIG. 1 of that patent). The depth of the recesses is therefore determined by the size of the bosses. Thus, to change the depth and/or the shape of these recesses, it will be necessary to replace the drum 34 with another drum having bosses of a different size and/or shape.

In U.S. Pat. No. 2,991,824, impressions 51A, 51B are made in a preform intended to be cut to give sheets of plasterboard, by means (see in particular FIG. 1 and column 3, lines 29 to 43 of that patent) of a band 20 rotating around two rollers 21 and having a projection 25. The preform is then cut in the middle of the impressions so as to produce sheets with feathered edges.

In this case too, to change the size and/or shape of the impressions, it would be necessary to replace the band 20 with another band having projections of different size and/or shape.

The invention is therefore aimed at solving the problem of making impressions in a preform while at the same time offering the possibility of changing the size and/or shape of these impressions quickly and easily.

More specifically, the apparatus according to the invention comprises at least:

a frame;
two first pulleys supported at a first end of the frame and two second pulleys at a second end of the frame; the first pulleys and second pulleys being in parallel planes; the pulleys facing each other being identical;
two transmission belts wrapped respectively around the first pulleys and the second pulleys;
at least one wire fixed removably to the belts and extending between these belts so that its longitudinal axis is parallel to the axis of rotation of the pulleys.

Thus, the invention makes it possible satisfactorily to produce sheets based on hydraulic binder with feathered edges.

Other features and advantages of the invention will now be described in detail in the description which follows and which is given with reference to the figures in which:

FIG. 1 schematically and in perspective depicts the upstream part of a production line for producing sheets based on hydraulic binder according to the invention;

FIG. 2 schematically and in perspective depicts the downstream part of a production line for producing sheets based on hydraulic binder according to the invention;

FIG. 3 schematically and in perspective depicts an apparatus for making impressions in the preform based on hydraulic binder;

FIG. 4 schematically and in section depicts the assembly of a wire onto a chain link;

FIG. 5 schematically depicts a wire gripper pin;

FIG. 6 schematically and in a view from above depicts a support piece mounted on a chain link;

FIG. 7 schematically depicts the support piece of FIG. 6, viewed from the front;

Figure 11:
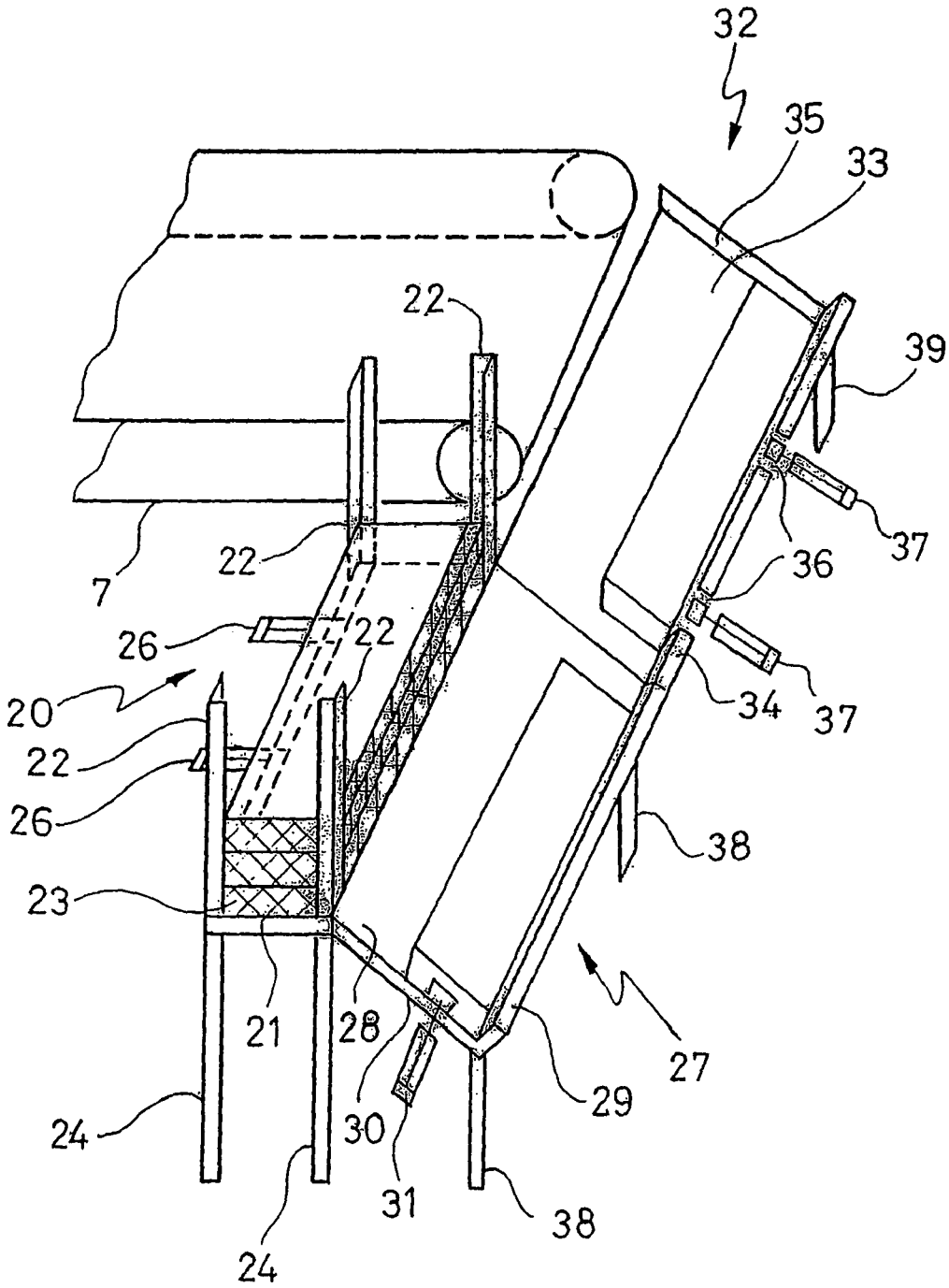
Figure 12:
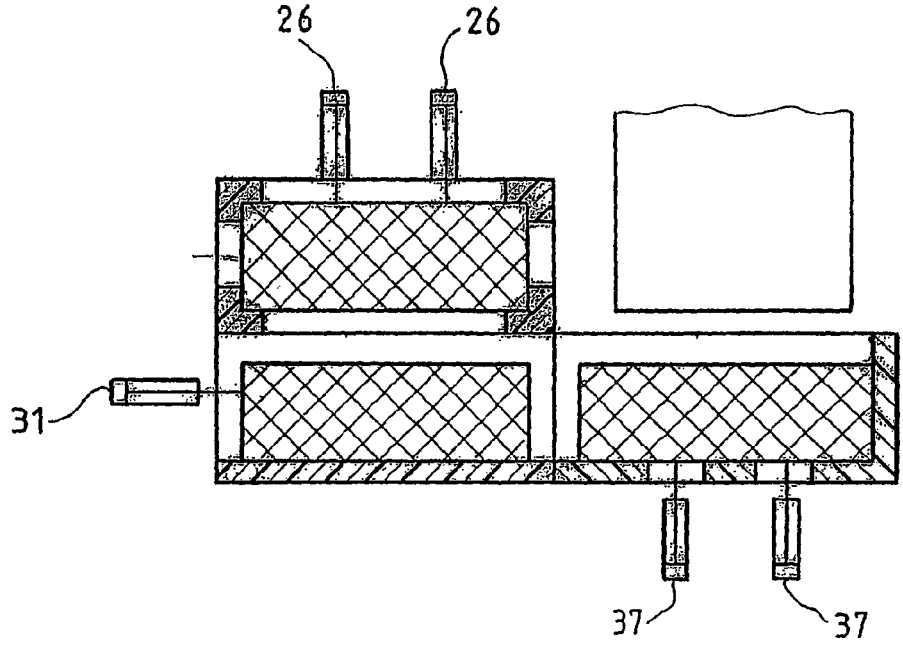
Figure 13:
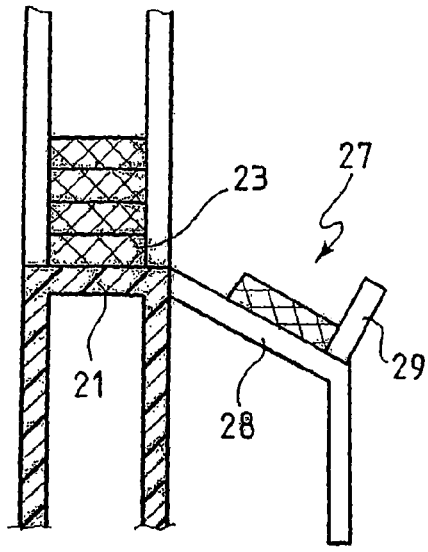
Figure 14:
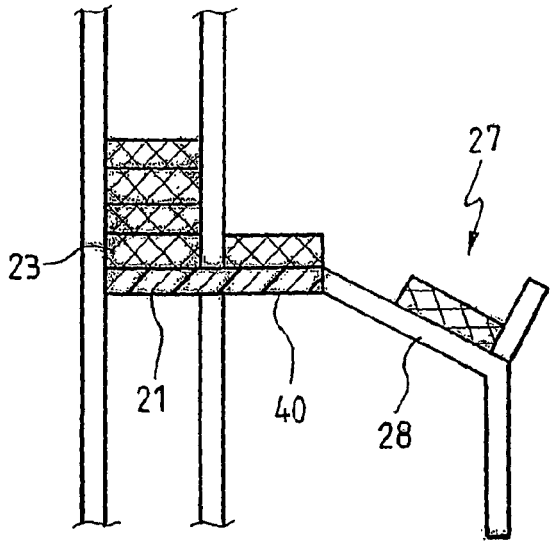
Figure 15:
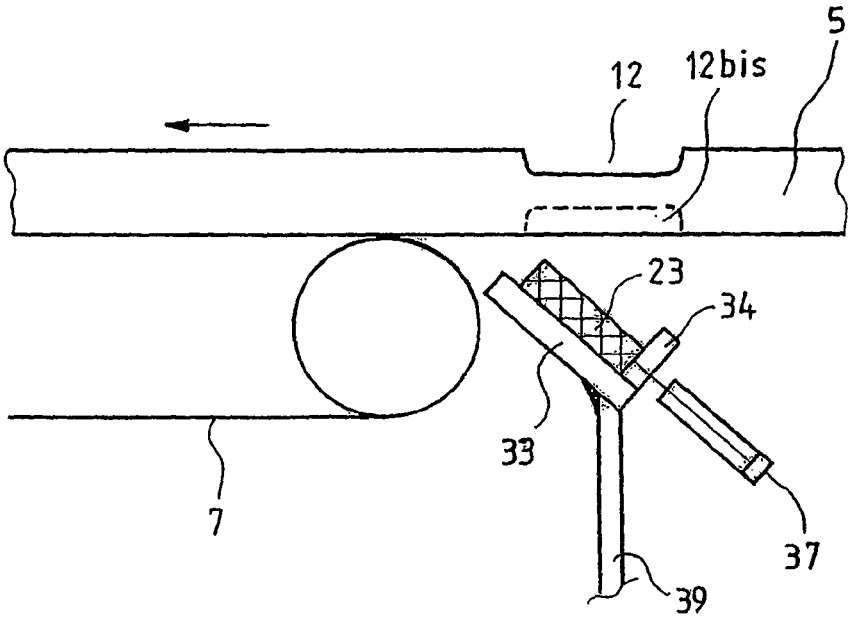
Figure 16:
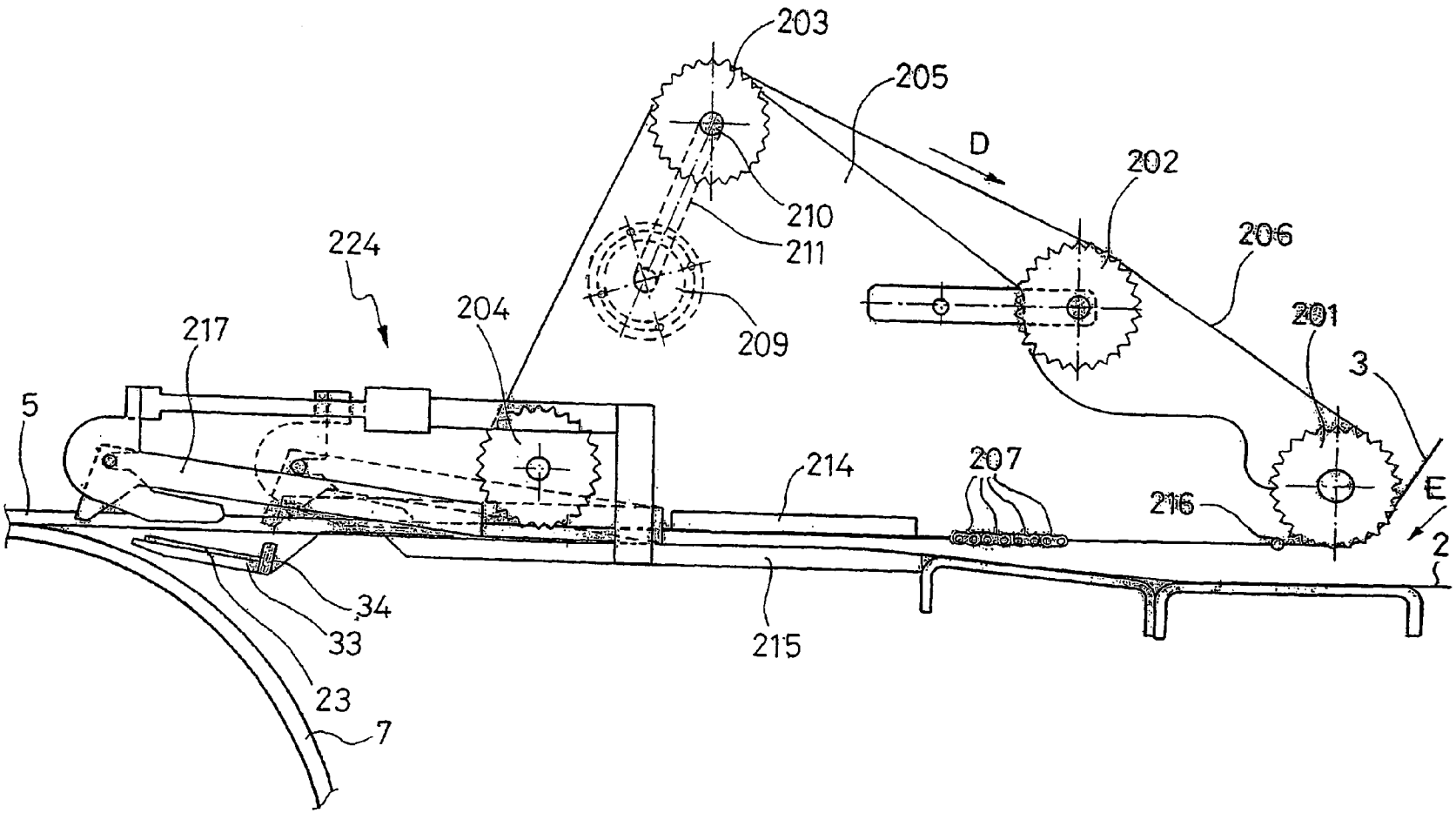
Figure 18:
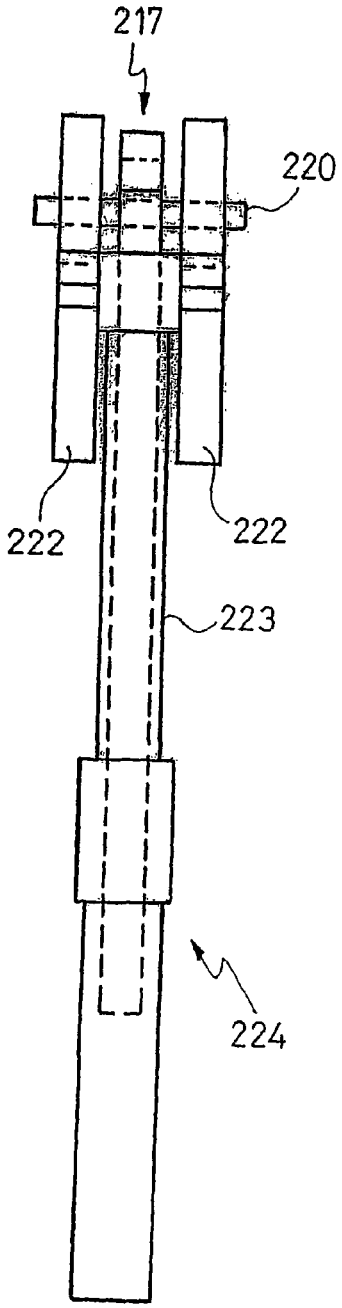
Figure 17:
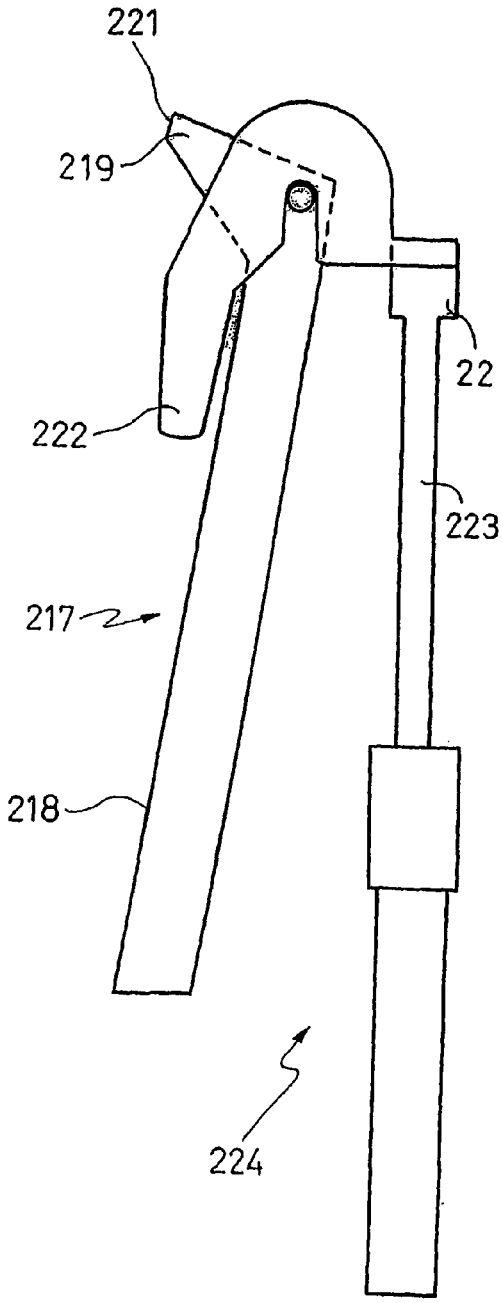

FIG. 11 schematically and in perspective depicts a device for introducing laths under a preform based on hydraulic binder;

FIG. 12 schematically and in a top view depicts the device of FIG. 11;

FIG. 13 schematically and in a side view depicts the device of FIG. 11;

FIG. 14 schematically and in a side view depicts an alternative form of the device of FIG. 11;

FIG. 15 schematically and in section depicts a detail of the device of FIG. 11 illustrating the introduction of a lath under a preform based on hydraulic binder;

FIG. 16 schematically depicts part of a production line for producing sheets based on hydraulic binder according to the invention comprising an alternative form of the apparatus for making the impressions; and FIGS. 17 and 18 schematically depict a pusher and its receptacle, these being elements of the apparatus for making the impressions of FIG. 16.

DETAILED DESCRIPTION OF THE INVENTION

Method According to the Invention

Figure 1:
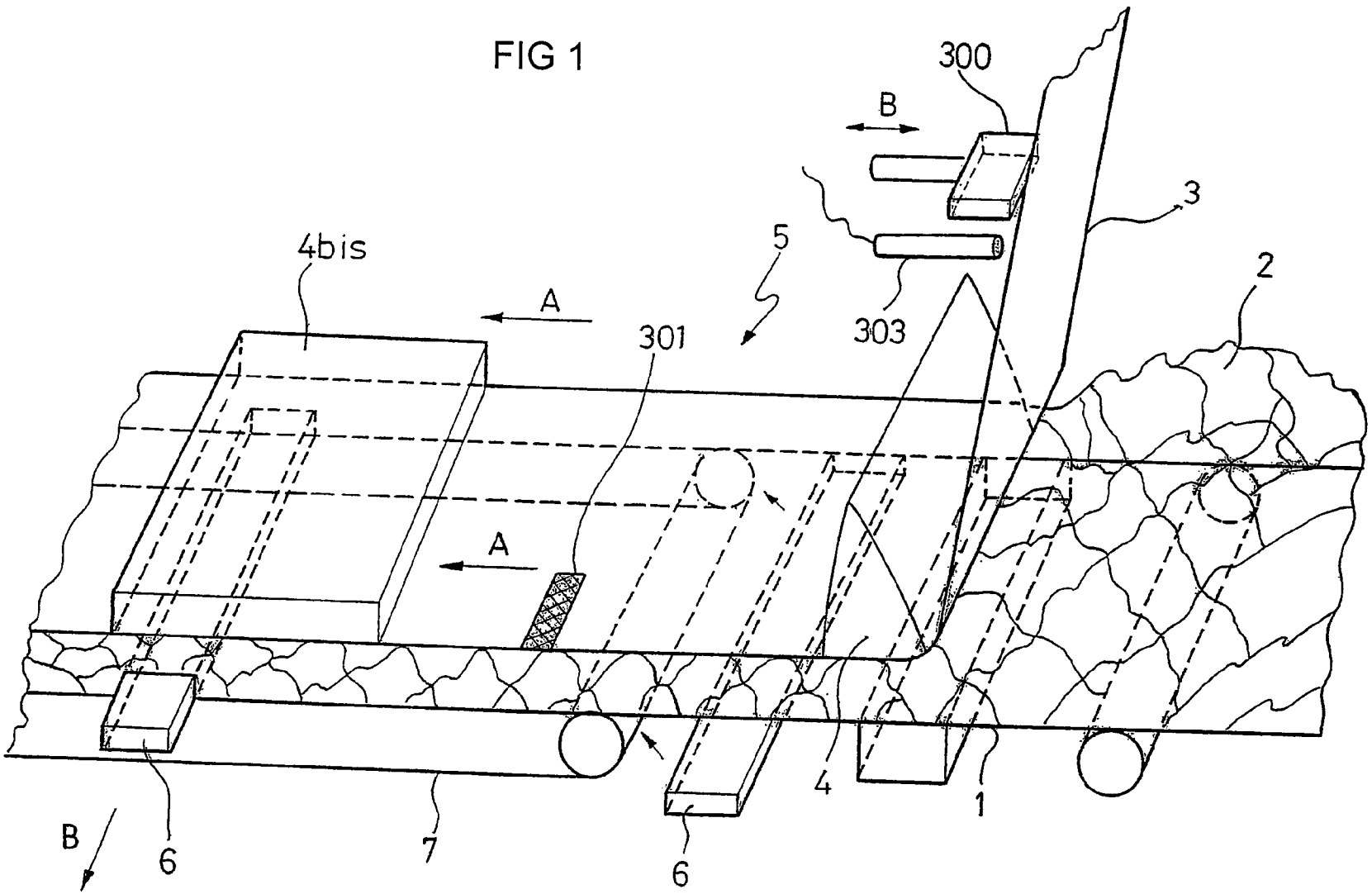

FIG. 1 shows an upstream part of a production line for producing sheets based on hydraulic binder.

In the upstream zone of the line, a hydraulic binder composition 2 is poured onto a facing material 1 and generally covered with a second facing material 3. The passage of the entity under the forming plate 4 gives a preform 5 which moves, supported by a conveyor belt 7, toward the downstream zone of the line where it is cut transversely by a cutting device 9 generally consisting of a roller equipped with a cutter (FIG. 2), to give sheets.

The terms "upstream" and "downstream" refer to the direction of travel of the preform 5.

The "upstream zone" is therefore intended in this description to mean the part of the production line situated near the forming plate 4.

The "downstream zone" is intended to mean the part of the production line situated near the cutting device 9.

The hydraulic binder composition preferably contains plaster.

The facing materials 1 and 3 may consist of sheets of paper, glass matting or any material known to the person skilled in the art as being able to be used as a facing.

According to the invention, marking means 300 are provided, generally upstream of the forming plate 4, to produce at least one mark, preferably on the facing material 3 of the preform 5.

The mark is therefore generally made upstream of the forming plate 4, that is to say before the preform 5 is formed.

The mark may be produced by depositing a material such as an ink on the surface of the facing material, so as to make a spot, a line or any sign. The deposited material may or may not be visible to the naked eye. The size of the mark may vary widely.

The mark may also consist of a relief or recess made on the surface of the facing material.

The marking means 300 may therefore consist of a piece forming an inking stamp which is moved regularly back and forth toward the facing material 3 as illustrated by the double-headed arrow B. When the piece forming a stamp comes into contact with the facing material 3 it leaves a mark 301 on the face of this material.

As an alternative, it is also possible to use other marking means 300 such as an encoder wheel coupled to an inkjet device to trigger clean printing (indexing the speed of the jet as a function of the rate of travel of the paper) at the desired frequency, controlled by the person skilled in the art or the operator.

Figure 2:
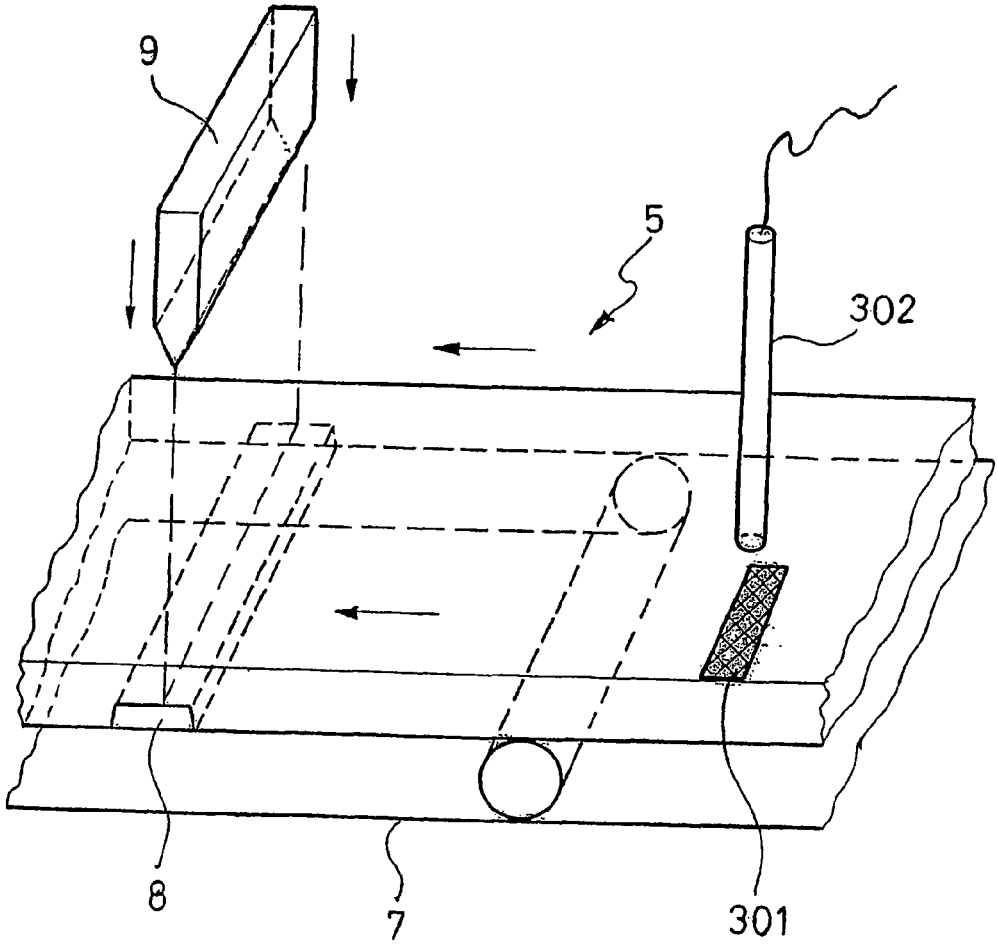

FIG. 2 also shows detection means 302 arranged above the preform 5, at an appropriate point so that when a mark 301 passes under them, they are able to detect it.

These detection means 302 are of course chosen according to the type of the mark that is to be detected. They may consist of a photoelectric sensor.

Thus, each time the presence of a mark 301 on the preform 5 is detected by the detection means 302, a detection signal is sent to actuating means (not depicted) which then send an actuating signal to the cutting device 9 so that the latter cuts the preform 5 to give a sheet.

According to an advantageous embodiment of the invention visible also in FIG. 1, additional detection means 303 are provided downstream of the marking means 300, preferably in the upstream zone, generally upstream of the forming plate 4.

These additional detection means 303 are generally of the same type as the detection means 302 because they need to be able to detect the mark 301.

Additional actuating means are then also provided to, having received a detection signal from these additional detection means 303, send an actuating signal to an apparatus for making an impression or reservation in the preform 5.

This additional detection of the mark 301 for making an impression therefore takes place before the mark 301 is detected in step 2) of the method which triggers the cutting of the preform 5.

The impression may be made by any means, for example by following the teachings of U.S. Pat. No. 2,991,824 or 4,781,558.

As a preference, however, use is made of an apparatus which will now be described in detail.

Making the Impressions

Figure 3:
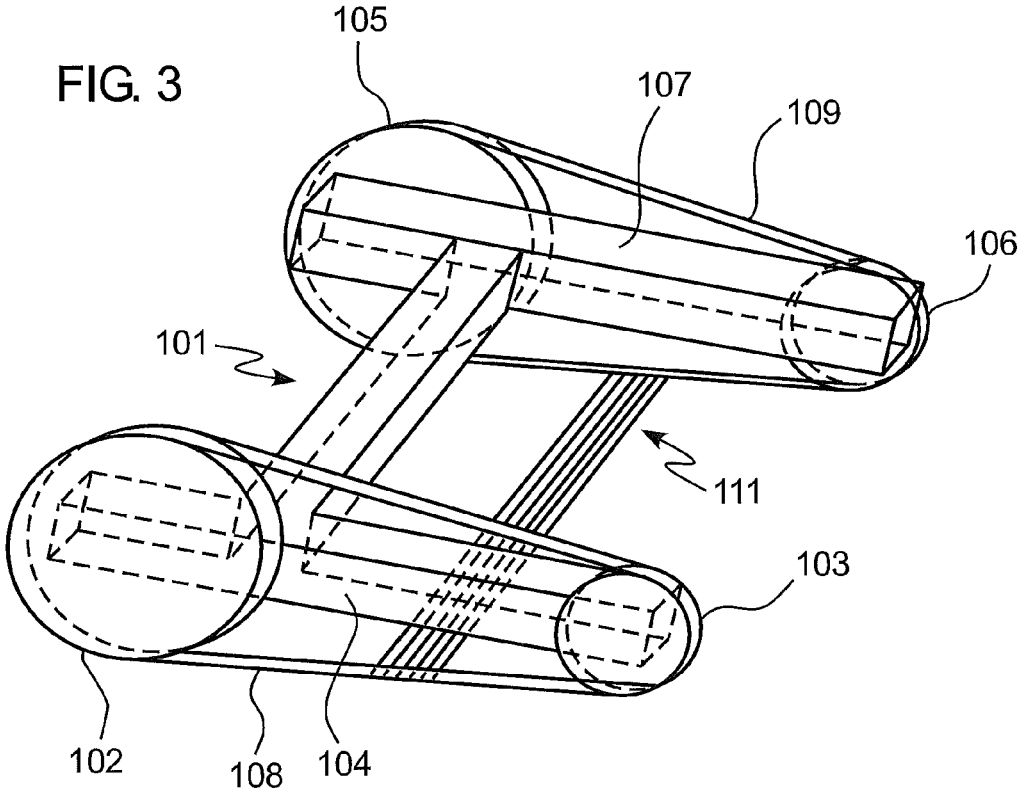

The preferred apparatus for making the impressions is depicted schematically in FIG. 3.

It comprises a frame 101 in the shape of an H but which can easily be given numerous other shapes by the person skilled in the art.

Supported on this frame 101 are, at a first end 104, two first pulleys 102 and 103 and, at a second end 107, two second pulleys 105 and 106.

The first pulleys 102, 103 lie in a first plane, the second pulleys 105, 106 in a second plane and the first plane is parallel to the second plane.

The pulley 102 and the pulley 105 are situated one facing the other and are identical.

The pulley 103 and the pulley 106 are also situated one facing the other and are identical.

The pulleys 102, 103, 105 and 106 can rotate about themselves.

A first transmission belt 108 is wrapped around the first pulleys 102, 103 and a second transmission belt 109 is wrapped around the second pulleys 105, 106.

The transmission belts 108 and 109 are identical. They are connected together by at least one wire 111.

This wire 111 is fixed removably to the first and second belts 108, 109 and extends between these belts 108, 109 so that its longitudinal axis is parallel to the axis of rotation of the pulleys.

Thus, when one of the pulleys, for example the pulley 102, turns, it drives the transmission belt 108 which itself drives the other pulley situated in the same plane as it (the pulley 103) and the wire 111. The latter therefore moves in the path defined, on the one hand, by the loop consisting of the belt 108 and, on the other hand, as it is connected to the second belt 109, also by the loop consisting of the latter.

The symmetry of the apparatus according to the invention therefore allows the axis of the wire 111 to move in an elliptical path, its axis remaining constantly parallel to that of the pulleys.

Provision may be made for two pulleys situated one facing the other to be fixed on one and the same shaft.

The apparatus may also comprise means for driving the rotation of at least one of the pulleys. These means may possibly drive two pulleys by means of the shaft on which they are mounted.

The wire 111 generally has a cylindrical shape, but it may adopt a great many shapes among which mention may be made of parallelepipedal, prismatic, etc. shapes.

It may be fixed for example by screwing to the transmission belts so as to be able to be unscrewed and replaced easily by another means of elongate shape.

According to a preferred embodiment of the invention, several wires 111 are arranged parallel to one another along the transmission belts 108 and 109 (see FIG. 3).

The pulleys are preferably sprockets and the transmission belts chains able to collaborate with these sprockets.

The wires may then be fixed in the way illustrated in FIG. 4.

This FIG. 4 shows a wire 111 held on a chain link 112 by means of a support piece 113 and a wire gripper pin 114.

The latter, in the chain link 112, replaces one of the roller bearing pins conventionally used.

The wire gripper pin 114 is shown in detail in FIG. 5. It comprises, in order:

- a threaded end 115,
- a generally cylindrical and plain part 116 able to be introduced into the roller of the chain link 112 to replace the roller bearing pin conventionally used,
- a plain part also generally cylindrical and plain 117, of a diameter generally greater than that of the part 116 and able to be introduced into the hole 118 in the support piece 113 (see FIGS. 6 and 7),
- a head 119, and
- a central bore 120 machined generally from the head 119, able to extend as far as the part 116 and intended to house the wire 111.

The support piece 113 is visible in FIGS. 4, 6 and 7.

It comprises the hole 118 able to collaborate with the corresponding part 117 of the wire gripper pin 114 and a bore 121 opening into the hole 118. This bore 121 is threaded so that a press screw 122 can be screwed into it to compress the wire 111 present inside the hole 118 with a view to holding it firmly (see FIG. 4).

Thus, to fix a wire 111 to the chain link 112, the set-up of FIG. 4 is achieved. To do that, all that is required is for the part 117 of the wire gripper pin 114 to be introduced into the support piece 113, for the normal roller bearing pin of the link 112 to be removed, for the part 116 of the wire gripper pin 114 to be introduced along the axis of the roller, and for the assembly to be tightened by screwing a nut 123 onto the end 115 of the wire gripper pin 114, for the wire 111 to be introduced into the central bore 120 of the wire gripper pin 114 and for it to be held there firmly by screwing the press screw 122 into the threaded bore 121 until it effectively compresses the wire 111.

Of course the wire gripper pin 114 is mounted in such a way that its head 119 is on the inside of the chain, that is to say on the side facing toward the other chain.

The support piece 113 preferably comprises two pairs (hole 118, threaded bore 121), the spacing between the axes of the holes 118 corresponding to the normal spacing between the axes of the rollers of a chain link 112, so that two wires 111 can be held on the same link 112, as can be deduced from FIGS. 6 and 7.

By thus having several identical support pieces 113 on adjacent links, it is possible to align several wires 111 in parallel so as to constitute a means of elongate shape.

In order for the apparatus which has just been described to be able to be used in an optimum manner on a production line for producing sheets based on hydraulic binder, the distance between the transmission belts of this apparatus is at least equal to the width of the preform 5. Thus, these belts and the pulleys lie on each longitudinal side of the preform.

Furthermore, the apparatus is arranged in an appropriate way so that when its transmission belts are turning, its wire or wires 111 creates or create an impression in the preform 5.

Figure 10:
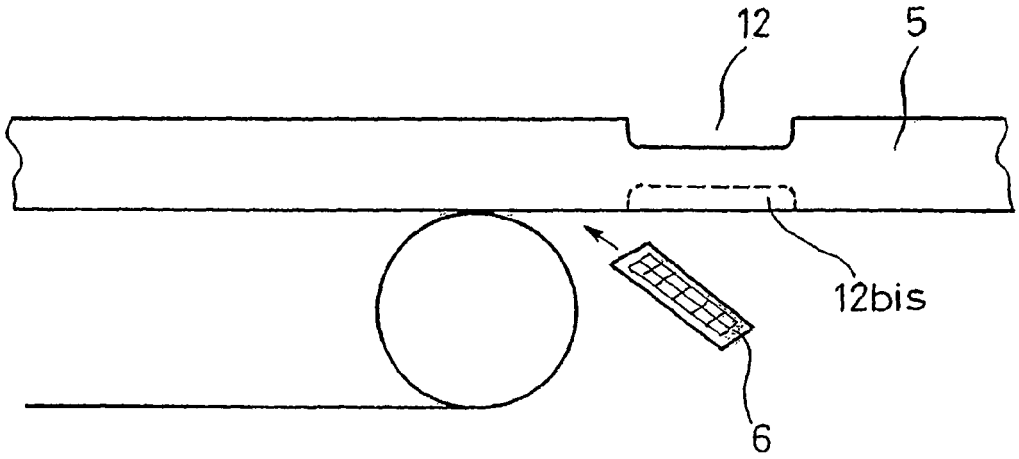
FIG. 10 illustrates an optional intermediate step in a method of manufacturing sheets based on hydraulic binder.

The apparatus may be above the preform 5, in which case it creates the impression 12, or under the preform 5, in which case it creates the impression 12*bis* visible in FIG. 10.

For practical reasons, it is preferable for the apparatus according to the invention to lie above the preform 5.

The operation of the motor is adjusted so that the transmission belts move at the same speed as the preform.

Of course, it would be possible to anticipate two (or more) apparatuses according to the invention, one situated above and the other below the preform, so as to create, respectively, an impression 12 on the top of the preform 5 and an impression 12*bis* on the underside of the preform 5 (see FIG. 10), the underside of the preform 5 being the side of this preform 5 which rests on the conveyor belt 7.

The position of the impression 12 is not directly connected to that of a mark 301, which means that an impression 12 may or may not be made on a mark 301.

Likewise, the position of the impression 12*bis* is not directly connected to that of a mark 301, which means that an impression 12*bis* may or may not be made under a mark 301.

The position of the mark 301 and that of the impression are advantageously chosen so that the preform 5 is cut at an impression 12.

Figure 8:
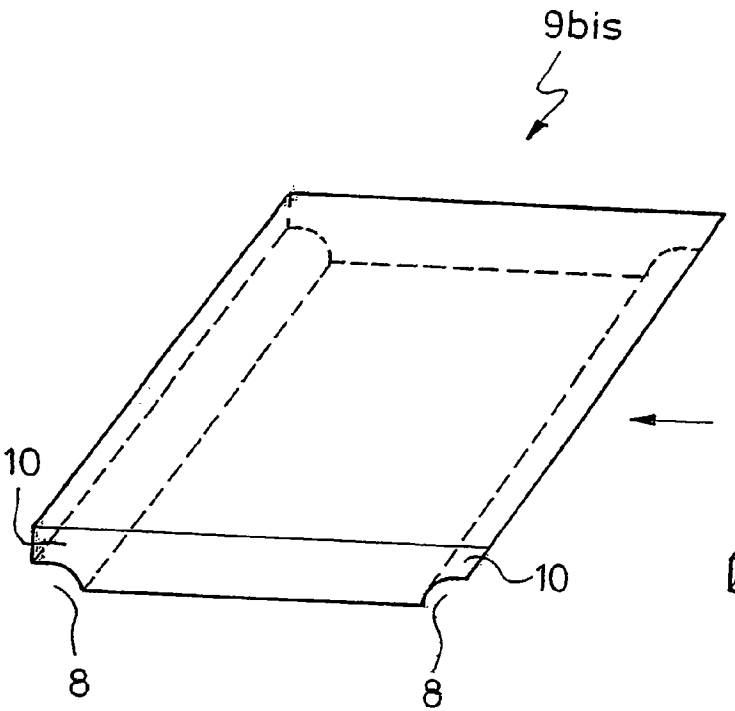
FIG. 8 depicts a sheet that can be obtained using the method according to the invention.

This then gives sheets 9*bis* with feathered transverse edges 10 visible in FIG. 8.

If faced with an impression 12*bis* made on the underside of the preform, the cutting device can be set to cut the preform opposite the place where this impression 12*bis* has been made (that is to say on the other face of the preform).

The preform is preferably cut approximately at the middle of the impression 12 or 12*bis*.

Introducing Laths Under the Preform

According to another embodiment, the additional actuating means are able, after receiving a detection signal from the additional detection means 303, to send an actuating signal to a device for introducing laths under the preform 5.

Thus, the method according to the invention supplements a method of manufacturing sheets of plasterboard with feathered (tapered) edges comprising the following steps (see FIG. 1):

1) a hydraulic binder composition 2 is poured onto a facing material 1 supported by a conveyor belt 7 so as to obtain a preform 5, then a lath 6 the length of which is at least approximately equal to the width of the preform 5 is introduced under the preform 5;
2) the hydraulic binder composition 2 is left to set 2 and said lath 6 is removed;
3) the preform 5 is cut at the feathering 8 created by the lath 6.

The additional detection means 303 and the electronic means therefore allow the lath 6 to be introduced under the preform 5 after the mark 301 has been detected, by sending an actuating signal to a device for introducing laths 6 under the preform 5.

This additional detection of the mark 301 for introducing laths 6 therefore takes place before detection of the mark 301 in step 2) of the method which triggers the cutting of the preform.

The position of the mark 301 is not directly connected to the introduction of the lath 6, which means that a lath 6 may or may not be introduced just under a mark 301.

This introduction of the laths 6 under the preform with a view to manufacturing sheets based on hydraulic binder with feathered edges will now be described in detail with reference to FIGS. 1, 2 and 8 to 15.

First of all, it is necessary to emphasize that "transverse edges" in this description are intended to mean the edges perpendicular to the direction of travel of the conveyor belt in a production line for producing sheets based on hydraulic binder. Such transverse edges are also known as "sheet ends".

With reference to FIG. 1, it can be seen that, after the preform 5 emerges from under the forming plate 4 or from under the equivalent device used in the production line (for example, a forming roll also known as a master roll), a lath 6 is introduced between the preform 5 and the start of the conveyor belt 7. The distance between the forming plate 4 and the start of the conveyor belt 7 is such that the preform 5 has not yet had time to harden appreciably and is still very plastic. Introduction is performed in such a way that the longitudinal axis of the lath 6 is substantially perpendicular to the direction of travel of the conveyor belt 7.

The lath 6 is then driven by the conveyor belt 7, like the preform 5. The plaster composition 2 then sets and hardens throughout the travel of the preform 5, denoted by the arrows A.

As a preference, the lath 6 is removed before the preform 5 is cut.

Thus, after a certain time, to which there corresponds a distance covered by the preform 5 on the conveyor belt 7 that the person skilled in the art knows how to determine as a function of the speed of travel of the conveyor belt 7 and of the time taken for the plaster composition to set, the hardness of the preform 5 is sufficient that the lath 6 can be removed without deforming the preform 5 and without the plaster composition 2 filling the space or feathering 8 (FIG. 2) left by the removal of the lath 6.

The lath 6 can be removed in any appropriate way. For example, when the length of the lath 6 exceeds the width of the preform 5, the lath 6 projects from the preform 5, and it can then be removed quickly in a direction substantially perpendicular to the direction of travel of the conveyor belt 7, and away from the latter. This removal action is illustrated by the arrow B in FIG. 1.

The lath 6 may also be removed by causing this lath 6 to drop into the space between two constitute rollers of the conveyor belt system which, in general, is not continuous along the entire length of the production line but is made up of several belts driven by rollers between which there are gaps.

After the lath 6 has been removed, the preform 5 continues to travel, still driven by the conveyor belt 7, and the plaster composition 2 continues to harden.

According to the invention and as can be seen in FIG. 2, the mark 301 is then detected, in the downstream zone of the production line, by the additional detection means 302 which then trigger the operation of the cutting device 9.

The position of the mark 301 and that of the feathering 8 are advantageously chosen so that the preform 5 is cut at the feathering 8, preferably approximately at the middle of this feathering.

This then gives sheets 9*bis* with feathered transverse edges 10 visible in FIG. 8, the lengths of which are defined by the distance covered by the conveyor belt between two cutting operations, that is to say, in general, by the distance covered by the conveyor belt between two consecutive featherings 8. This sheet 9*bis* therefore has two feathered transverse edges 10.

The size of each feathering 8 depends on the size of the lath 6. The latter is generally a parallelepiped generally of between 0.5 and 4 mm and preferably between 1.5 and 4 mm thick. Its width is generally between 5 and 20 cm and its length is at least approximately equal to the width of the preform 5 (possibly reduced by the width of the longitudinal bands (tapes) that might be present), but generally greater so that it can be grasped for removal from under the preform 5. Furthermore, it is desirable for the lath 6 to be longer than the width of the preform 5, so that it projects with respect to the latter, which may make it easier to remove.

The material of which the laths 6 are made is of little importance, provided that it allows these laths to withstand the weight of the thickness of the preform 5 lying on top of each lath 6. It may therefore be made of a plastic, wood, metal, etc., with good resistance to wear and good stability over time.

As a preference, the method which has just been described supplements a known method for manufacturing sheets of plasterboard having two feathered longitudinal edges. The latter method generally anticipates the placement of a band, generally made of plastic, and generally known as a tape, along each longitudinal side of the conveyor belt 7. Such a method is described for example in European patent application No. 482 810.

Figure 9:
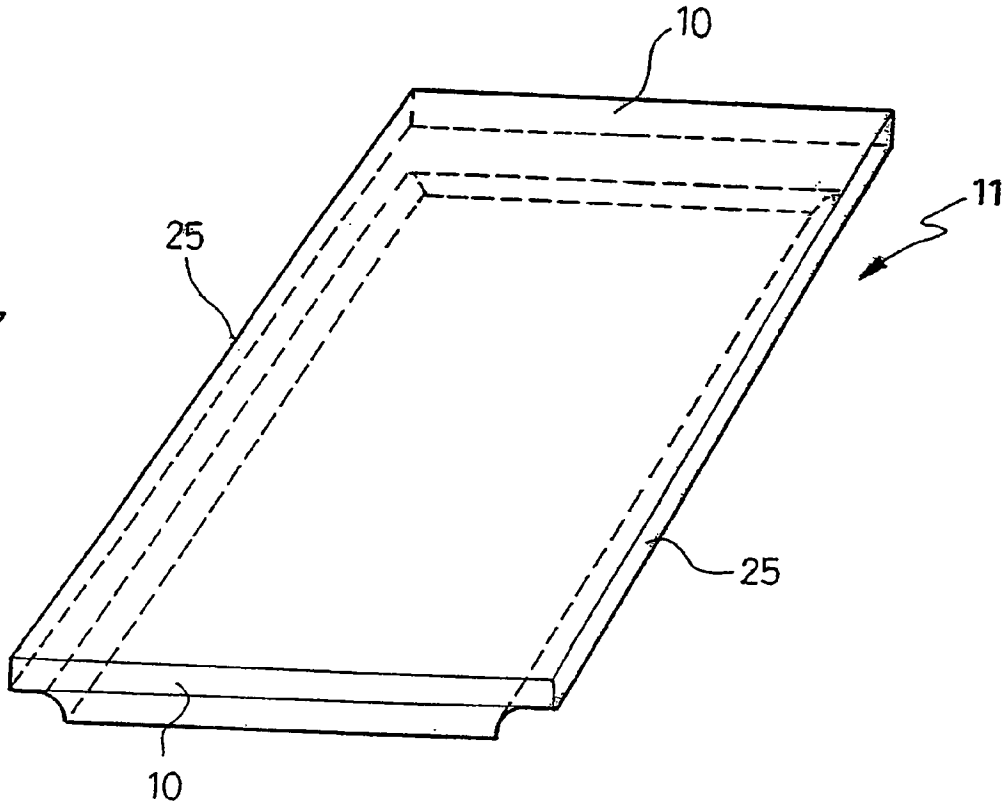
FIG. 9 depicts another sheet that can be obtained using the method according to the invention.

This therefore makes it possible to obtain a sheet based on hydraulic binder 11 as illustrated in FIG. 9 which, apart from its two feathered transverse edges 10, has two feathered longitudinal edges 25, namely four feathered edges in total.

The length of the sheets of plasterboard manufactured depends of course on the rate of travel of the conveyor belt and on the frequency of the cutting operations.

The frequency of the cutting operations is generally directly connected to the frequency with which the laths are introduced, because in general the desire is to obtain sheets with two feathered transverse edges, and the frequency with which the laths are introduced is a function of the detection of the marks 301 and therefore of the frequency of the marking operations.

This way of manufacturing sheets with feathered edges is very flexible because, in order to change the length of the sheets manufactured, it is generally sufficient simply to alter the frequency of the marking operations, this frequency determining the frequency with which the laths are introduced and the frequency of the cutting operations.

Combination of the Making of Impressions and the Introduction of Laths

According to one particularly advantageous embodiment of the invention, the method according to the invention involves both making an impression 12 or 12*bis* in the preform 5 and introducing a lath 6 under the preform 5.

The additional actuating means are therefore able, after detection of a mark 301 by the additional detection means 303, to send an actuating signal to the means of making the impression 12 or 12*bis* and an actuating signal to the device for introducing laths 6, so as to introduce a lath 6 under the preform, to allow setting to take place, then to remove the lath 6, as explained above.

In general, the steps of introducing a lath 6 under the preform 5 then of the hydraulic binder composition setting and of the lath 6 being removed take place after the step of making the impression in the preform 5.

The impression is preferably made either opposite the place where the lath 6 is to be introduced (impression 12) or at the place where this lath 6 is to be introduced (impression 12*bis*).

That makes it possible to compensate for localized additional thicknesses which may possibly be formed in the preform 5 because of the displacement of material when the lath 6 is of significant size.

It is also possible, with a view if necessary to attenuating local additional thicknesses, to anticipate the presence of a smoother 4*bis* of conventional type (visible in FIG. 1) downstream of the place where the lath 6 is introduced.

Production Line for Producing Sheets Based on Hydraulic Binder

The production line for producing sheets based on hydraulic binder according to the invention is preferably a production line for producing sheets based on hydraulic binder with feathered edges.

Such a line may comprise a device for introducing laths and/or means for making impressions.

A production line for producing sheets based on hydraulic binder with feathered edges equipped with means or with a device for introducing laths 23 under the preform 5 will first of all be described in detail with reference to FIGS. 1, 2 and 8 to 15.

Device for Introducing Laths Under the Preform

Referring to FIG. 11, it is possible to see the upstream zone of a production line for producing sheets based on hydraulic binder, comprising a device for introducing laths under the preform.

This device comprises a laths magazine 20 formed of a horizontal rectangular surface 21 from the corners of which there rise vertically and in parallel four bracket-shaped angular pieces 22 facing toward each other, so as to flank a stack of laths 23.

The size of this laths magazine 20 is such that it can store a great many laths 23 (see also FIGS. 12 and 13).

The horizontal surface 21 of the laths magazine 20 is supported on legs 24.

At the first lath 23, that is to say the one at the very bottom of the pile, there are, arranged in parallel, two rams 26 which are oriented in such a way as to extract the first lath 23 from the pile by pushing it and causing it to slide toward an inclined plane 27 consisting of a downwardly inclined surface 28 and of a rim 29 at its lower part to retain the lath which has just been extracted and guide it later.

On the transverse side 30 of the inclined plane 27, that is to say on the opposite side to the conveyor belt 7, a ram 31 is arranged parallel to the longitudinal axis of the inclined plane 27 so that actuation of this ram 31 can give an impulse to the lath which has just been extracted from the laths magazine 20. The lath thus propelled can therefore move, sliding parallel to the longitudinal axis of the inclined plane 27, the rim 29 of which guides it, toward a second inclined plane 22 in the continuation of the first inclined plane 27, on the opposite transverse side to the side 30. This second inclined plane 32 also consists of an inclined surface 33 equipped with a rim 34 at its bottom. It further comprises a stop 35 on its opposite end to the ram 31, this stop generally consisting of a pneumatic damper and being intended to end the movement of the lath propelled by the ram 31.

The rim 34 is equipped with openings 36 facing which there are two rams 37 oriented in such a way as to propel the lath positioned on the second inclined plane 32 toward the top of the inclined surface 33.

The first inclined plane 27 and the second inclined plane 32 are supported on legs 38 and 39 respectively.

According to an alternative form visible in FIG. 14, a flat surface 40 is provided parallel to the surface 23, between this surface and the first inclined plane 27, to horizontally support a lath extracted from the laths magazine 20 before it descends along the inclined surface 28 of the first inclined plane 27.

Thus, as can be seen in FIG. 15, the height of the legs 24, 35 and 36 is chosen so that a lath positioned on the second inclined plane 32 lies at a lower height than the preform 5.

In general:

- the longitudinal axis of the rim 34 of the second inclined plane 32 is perpendicular to the longitudinal axis of the conveyor belt;
- the means 32, 33, 34, 35 for supporting the displaced lath lie facing the start of the conveyor belt 7; and
- the inclined surface 33 of the second inclined plane 32 is adjacent to the conveyor belt 7.

The length of the second inclined plane 32 is at least equal to that of the lath 23, that is to say at least equal to, and preferably greater than, the width of the preform 5.

Thus, as can be understood by referring to FIG. 10, when the rams 37 are actuated, the lath on the second inclined plane 32 is pushed up toward the top of the inclined surface 33, that is to say toward the conveyor belt 7 and the preform 5, and finds itself wedged between these and driven along by them.

The difference between the length of the lath and the width of the preform 5 allows the lath to be grasped and removed once the plaster composition has hardened.

The production line according to the invention generally comprises electronic means which control its operation and, as necessary, allow the performance of various operations to be slaved to one another.

These electronic means may make provision that, after a lath has been introduced under the preform by actuation of the rams 27, the ram 31 is actuated to introduce another lath onto the second inclined plane 32, then the rams 26 are actuated to introduce another lath onto the first inclined plane 27, and so on.

As explained hereinabove, the electronic means are able to send an actuating signal to the device for introducing the laths 23 after receiving a detection signal from the additional detection means 303.

Thus, the frequency with which the laths are introduced under the preform is determined by the frequency with which the marks 301 are made on the facing material 3 of the preform 5.

Alternative Form of the Apparatus for Making Impressions

A production line for producing sheets based on hydraulic binder with feathered edges equipped with an apparatus for making impressions as has been described in general hereinabove will now be described.

FIG. 16 represents the upstream zone of such a line comprising an alternative form of the apparatus for making impressions that can be seen in profile in this figure.

According to this alternative form, the apparatus comprises four first sprockets 201, 202, 203, 204 supported by a frame 205 and with, wrapped around them, a chain 206 made up of links of which some, the links 207, each support two wires, in the way indicated in conjunction with FIG. 2.

This apparatus is symmetric with respect to a vertical plane aligned with the direction of travel of the preform 5. Thus, the wires held on the links 207 extend transversely with respect to the preform 5 as far as a second chain, identical to the chain 206, and wrapped around second sprockets identical to the first sprockets 201, 202, 203, 204.

The apparatus is equipped with an electric motor 209 driving the rotation, via a belt 211, of the shaft 210 on which the sprocket 203 and its symmetric sprocket are mounted. The turning of these sprockets drives the rotation of the chain 206 in the direction indicated by the arrow D.

This preform 5 is obtained in a known way by introducing hydraulic binder slurry in the direction of the arrow E between the first facing material 2 and the second facing material 3 and passing the entity between the upper 214 and lower 215 forming plates of the apparatus.

The distance between the sprockets 201, 202, 203, 204 and their symmetric sprockets is at least equal to the width of the preform 5 so that these sprockets do not touch this preform 5.

The apparatus according to the invention is fixed at an appropriate height so that when the production line is operating, the movement of the chain 206 driving the movement of the wires connected to the links 207, these wires pass through the forming plate, that is to say between the plates 214 and 215, and project downward with respect to the upper plate 214. The space occupied by these wires between the upper plate 214 and the second facing material 3 therefore results at this point in a feathering of the thickness of the preform 5.

It goes without saying that the operation of the motor is adjusted in such a way that the chain 206 moves at the same speed as the preform 5. The wires therefore accompany the preform 5 over a few centimeters and, when they separate from it to return, rotating about the sprocket 204, they leave an impression in the upper part of the preform 5.

As explained above, the electronic means of the production line are able to send an actuating signal to this apparatus for it to make each impression after receiving a detection signal from the additional detection means 303.

Combined Use of an Apparatus for Making Impressions and of a Device for Introducing Laths According to one particularly advantageous embodiment of the invention, the means for making impressions collaborate with the device for introducing laths under the preform 5 (consisting of the means 20 to 22 and 24 to 39 described hereinabove in conjunction with FIGS. 11 to 15).

The additional actuating means are therefore able, after the additional detection means 303 have detected a mark 301, to send an actuating signal to the means of making the impression 12 or 12*bis* and an actuating signal to the device for introducing laths 6.

Although it is possible to use any appropriate means for making the impressions, use is preferably made of the apparatus which has just been described with reference to FIG. 3 and, more preferably still, of the alternative form described with reference to FIG. 16.

This alternative form is then advantageously arranged upstream of the device for introducing the laths.

The electronic means therefore preferably calculate the precise moment at which they need to send the actuating signals to the apparatus for making impressions and to the device for introducing laths, so as to synchronize their operation so that the lath is introduced in an impression 12*bis* lying on the underside of the preform 5, or alternatively, if the impression 12 is on the top face of the preform 5, substantially opposite this impression 12.

According to a preferred embodiment of the collaboration between the apparatus for making impressions and the device for introducing laths under the preform, the laths 23 are introduced under the preform 5 partly by the apparatus for making impressions.

As an alternative, this mechanical link between the apparatus for making impressions and the device for introducing laths can be replaced by a combined apparatus grouping together both means for making impressions and means for introducing laths.

This makes it possible to obtain easy and perfect synchronization of said apparatus and said device, resulting in the laths being introduced at the best time, or, in other words, at the best position relative to the preform 5.

In order to obtain such synchronization, the rams 37 (FIG. 15) are replaced by pushers 217 which can fit into the openings 36 in the rim 34 (FIG. 11).

The chain 206 is then provided with a pushing finger 216 which is fixed on the outside of the chain 206, that is to say on the opposite side to the side on which the wires are located. This pushing finger 216 has the function of striking and moving the pusher 217 as the chain 206 turns. It may be fixed to a link of the chain 206 for example in place of a roller bearing pin of this link.

In FIG. 16 it is possible to see the inclined surface 33 of the device for introducing the laths (FIG. 15) and its rim 34 and a lath 23 resting on the inclined surface 33.

The shape of a pusher 217 is more visible in FIGS. 17 and 18. This pusher comprises an elongate rule-shaped part 218 equipped at one end with a part in the shape of a right triangle 219 through which there passes a pin 220 which protrudes from both sides of the part 219. The vertex of the right triangle is truncated to give a face 221 parallel to the axis of the rule-shaped part 218.

Returning to FIG. 16, it can be seen that the pusher 217 can occupy two positions. In its initial position (depicted in dotted line) it rests on the plate 215 and faces toward the floor, so that its pin 220 is arranged transversely with respect to the preform 5 and its face 221 is at the lower part of the inclined surface 33, in the opening 36 in the rim 34.

When the pusher 217 is struck by the pushing finger 216, it moves, raising the inclined surface 33. In doing this, it pushes the lath 23 which then becomes inserted between the preform 5 and the conveyor belt 7.

The pushing finger 216 on the chain 206 lies some distance away from the wires held by the links 207 such that the lath 23 is introduced substantially opposite the location on the preform 5 where said wires have just formed the impression. The consequence of this is that the displacement of material caused by the introduction of the lath 23 is at least partially compensated for by the impression. It then follows that the preform has no lump on the opposite side to where the lath 23 was introduced. What this means is that once this lath 23 has been removed, the feathering obtained on the underside of the preform 5 does not bear a corresponding lump on the top of the preform 5.

The pusher 217 moved by the pushing finger 216 reaches a second position, completing its travel, in a receptacle visible in FIGS. 17 and 18 and which is formed by two arched pieces 222 fixed by their upper ends on each side of the outer end 225 of the rod 223 of a ram 224. Each side of the pin 220 of the pusher 217 is housed in an arched piece 222 and the parts 219 and 218 of the pusher 217 can fit into the space formed between the arched pieces 222, under the rod 223 of the ram 224.

In FIGS. 17 and 18, the rod 223 of the ram 224 is deployed, to receive the pusher 217.

However, as visible in FIG. 16, by retracting the rod 223 of the ram 224 into the body of this ram, the pusher 217 is returned over its initial position, then, by once again deploying the rod 223 of the ram 224, the pusher 217 is separated from the arched pieces 222 and drops down onto the plate 215. It therefore finds itself in its initial position, with its face 221 inside the opening 36.

It goes without saying that the dimensions of the pusher 217 are chosen so that it remains above the inclined surface 33.

The ram 224 may be fixed to the frame 205 of the apparatus, its location and size being determined according to the pusher 217 with which it has to collaborate. The ram 224 therefore has the function of returning the pusher 217 to its initial position. Its rod 223 is normally in the deployed position, waiting to receive the pusher 217.

Of course, the entire apparatus is designed symmetrically, each of the chains being equipped with a pushing finger 216 each collaborating with a ram 224, all this being in synchronism.

The electronic and pneumatic (or possibly hydraulic) means on the production line drive the operation of the apparatus for making the impressions and of the device for introducing the laths under the preform (consisting of the means 20 to 22 and 24 to 39 described hereinabove) so that once the pusher 217 has been returned to its initial position and the rod 223 of the ram 224 has been deployed once again, another lath 23 can be slipped along the inclined plane 33.

Provision may be made for actuation of the ram 224 to be determined by detection, for example, by means of a photoelectric sensor, of the passage of a stud or finger fixed at an appropriate point on the chain 206, for example in the same way as the pushing finger 216, this stud acting as a flag, that is to say that when detected by the photoelectric sensor positioned at a suitable point on the production line or on the apparatus, the electronic means command the return of the rod 223 of the ram 224 into the body of the ram, this return, as explained hereinabove, causing the pusher 217 to return to its initial position. End-of-travel sensors for the ram 224 may then, once the rod 223 has been retracted, cause further actuation of the ram 224 to deploy its rod 223, causing the pusher 217 to drop into its initial position.

The frame 205 of the apparatus may, as is apparent from FIG. 16, be secured to the plates 214 and 215. It then follows that the apparatus can be used in place of a forming plate or master roll conventionally used.

The invention claimed is:

1. A method of manufacturing a sheet based on hydraulic binder from a preform intended to be cut, this method comprising the step of providing an apparatus for making an impression in a preform based on hydraulic binder, this apparatus comprising at least:

a frame;

two first pulleys supported at a first end of the frame and two second pulleys at a second end of the frame; the first pulleys and second pulleys being in parallel planes; the pulleys of the first pulleys and second pulleys facing each other being identical;

two transmission belts wrapped respectively around the first pulleys and the second pulleys; and at least one wire fixed removably to the belts and extending across a gap between the two transmission belts so that its longitudinal axis is parallel to the axis of rotation of the pulleys and so that the longitudinal axis of the at least one wire is perpendicular to the direction of travel of the two transmission belts, actuating said apparatus on a preform so that the at least one wire makes an impression on the preform, and actuating a cutting device to cut the preform.

2. The method according to claim 1, further comprising the step of cutting the preform at the impression or opposite the place where the impression has been made.

3. The method according to claim 1, wherein the hydraulic binder contains plaster.

4. The method according to claim 1, wherein the apparatus includes a plurality of wires, at least two of the wires being adjacent each other.

5. The method according to claim 1, wherein the two first pulleys are provided on the first end of the frame on a side of the preform that is parallel to a moving direction of the preform, and the two second pulleys are provided on the second end of the frame that is opposite the first end and on the other opposing side of the preform, such that the two first pulleys are separated from the two second pulleys by the width of the preform, the width of the preform being transverse to the moving direction.

6. The method according to claim 1, wherein each of the two transmission belts has a width that is smaller than a width of the preform, the width of the preform being transverse to a moving direction of the preform.

7. The method according to claim 1, wherein the frame is H-shaped.

8. The method according to claim 7, wherein the two first pulleys are provided on one leg of the H-shaped frame, and the two second pulleys are provided on the opposing parallel leg of the H-shaped frame.

9. The method according to claim 1, wherein the parallel planes are on opposites sides of the frame, and the two first pulleys are provided in one of the parallel planes and the two second pulleys are provided in the other of the parallel planes.

10. The method according to claim 1, wherein the apparatus is actuated from above the preform or from below the preform.

11. The method according to claim 1, wherein the two first pulleys have different sizes.

12. The method according to claim 1, wherein the two first pulleys are separated from the two second pulleys horizontally across a width of the preform, the width of the preform being transverse to a moving direction of the preform.

13. The method according to claim 1, wherein the gap is the width of the preform.

* * * * *